US008950639B1

(12) United States Patent
Moss

(10) Patent No.: US 8,950,639 B1
(45) Date of Patent: Feb. 10, 2015

(54) REPLACEABLE EXECUTIVE POCKET LINER

(76) Inventor: Sandra B Moss, St. Albans, WV (US)

( * ) Notice: Subject to any disclaimer, the term of this patent is extended or adjusted under 35 U.S.C. 154(b) by 155 days.

(21) Appl. No.: 13/529,211

(22) Filed: Jun. 21, 2012

(51) Int. Cl.
*A45F 5/02* (2006.01)
*B43K 23/00* (2006.01)

(52) U.S. Cl.
CPC ..... *B43K 23/001* (2013.01); *A45F 5/022* (2013.01)
USPC ..... 224/230; 2/250; 206/37; 24/10 R

(58) Field of Classification Search
CPC ..... A45F 5/02; B43K 25/00; A41D 27/20
USPC ..... 224/230, 182, 615, 668, 673; 2/247, 2/250; 206/37, 214; 24/10 R, 11 R, 11 HC; 403/221, 332
See application file for complete search history.

(56) References Cited

U.S. PATENT DOCUMENTS

| | | | | | |
|---|---|---|---|---|---|
| 915,892 | A | * | 3/1909 | Schafer | 2/250 |
| 1,366,329 | A | * | 1/1921 | Bode | 24/12 |
| 1,833,222 | A | | 11/1931 | Lischeid | |
| 2,613,413 | A | * | 10/1952 | Budny | 24/10 R |
| 2,654,130 | A | * | 10/1953 | Lundberg | 24/10 R |
| 2,697,258 | A | * | 12/1954 | Uyal | 24/10 R |
| 3,371,829 | A | * | 3/1968 | Phillips | 224/230 |
| 3,396,885 | A | * | 8/1968 | Giondi | 224/438 |
| 3,466,779 | A | * | 9/1969 | Cooper et al. | 40/586 |
| 3,619,817 | A | * | 11/1971 | Rockwell | 2/250 |
| 4,310,109 | A | | 1/1982 | Coyle | |
| 4,903,745 | A | * | 2/1990 | Roman | 150/134 |

* cited by examiner

*Primary Examiner* — Justin Larson
*Assistant Examiner* — Scott McNurlen
(74) *Attorney, Agent, or Firm* — Dinsmore & Shohl LLP; Monika J. Hussell, Esq.

(57) ABSTRACT

A pencil or pen holder pocket liner having a replaceable main body that is impervious to ink and is fitted with a customizable front portion that hangs outside the pocket and joins with the replaceable pocket liner by means of a slide tab that inserts into a slot in the replaceable pocket liner.

12 Claims, 2 Drawing Sheets

REPLACEABLE EXECUTIVE POCKET LINER

BACKGROUND OF THE INVENTION

1. Field of Invention

The present invention relates generally to article holders. More particularly, the present invention relates to container-type holders for pens or pencils.

2. Description of the Prior Art

Pencil or pen containers that fit with the pocket of a shirt are known. In such a pencil container, the pocket of the shirt acts as a sheath for the main body of the container, which body includes a back panel extending the full depth of the pocket, an integral guard extending above the shirt pocket and a front panel integrally connected to the back panel extending substantially the depth of the pocket. An opening for the insertion of pencils is formed between the front and back panels. A pocket panel extends integrally from the top of the front panel over the shirt pocket and downwardly to lie adjacent to the exterior of the shirt pocket.

U.S. Pat. No. 1,833,222 (Lischeid) discloses an article holder with loops for the pens or pencils, but the article holder projects above the pocket of the shirt and the loops are visible. U.S. Pat. No. 2,697,258 (Uyal) discloses an article holder with loops that is held in place with a spring loaded metal plate. U.S. Pat. No. 3,371,819 (Phillips) discloses an article holder, but it projects above the level of the pocket and does not have the facility for replacement in the event of ink leakage, and it does rise to the level appropriate for business or medical professionals. U.S. Pat. No. 4,310,109 (Coyle) discloses an article holder with a complex wire place.

The prior art pencil containers work adequately for protecting a shirt pocket from being marked by pens and pencils inserted therein. None of the prior art anticipates the use of a replaceable pocket insert and a reusable front portion with a tab for insertion into the replaceable pocket. In addition, while prior art pen containers are common among engineers, they fail to rise to the level desired by business executives and/or medical personnel.

SUMMARY AND OBJECTS OF THE INVENTION

The principal object of the present invention is to provide an article holder that will protect a professional executive's shirt, blouse, vest, coat, dress, smock or other professional attire from adventitious ink leakage and has a customizable front for a medallion appropriate for said executives.

In accordance with the objects of the invention, a pen holder having a front panel and back panel is connected along three sides, leaving the top of the front panel unconnected to form an opening with the back panel for receipt of pens, pencils, laser pointers or other suitable items. The penholder has a slot in its front panel to accept a tab section of the front portion that will overhang the shirt pocket.

With regards to this invention, pen means any pen, pencil, pointer, laser pointer or other suitable pocket items. With regards to this invention shirts pocket means shirt pockets, blouse pockets, vest pockets, dress pockets, jacket pockets, lab coat pockets, smock pockets or other pockets on garments worn by professionals. With regards to this invention the phrase slot for insertion includes a loop for insertion or other joining means that permit separation of the replaceable pocket insert from the front medallion.

BRIEF DESCRIPTION OF THE DRAWINGS

FIG. 8 illustrates a fold just above the customizable portion of the medallion. However, the piece may be fabricated of plastic or other suitable deformable material such that the fold is molded into the piece. In an embodiment the length of the medallion may be 3¼" long, the width of the front piece may be 2", and the slit cut may be 2⅔" long.

Figure 1:
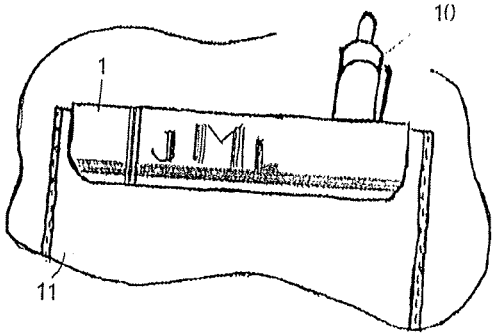
FIG. 1 is the front elevation of the pencil holder/pocket protector constructed in accordance with the design and shown in position on the outer breast pocket 11. Pen 10 held therein inserted in a loop 6 in FIG. 4.
Figure 2:
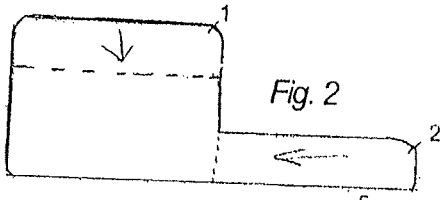
FIG. 2 illustrates one embodiment of the front piece and tab, which inserts into the replaceable pocket. This embodiment is made of a suitable metal and is folded along the dotted lines illustrated in FIG. 2. It comprises the exterior portion that may be customized and an interior portion with a tab that inserts into a slot in the replaceable pocket.
Figure 3:
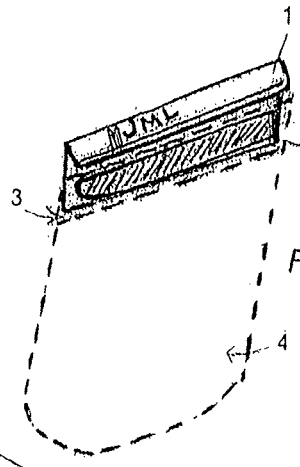
FIG. 3 further illustrating the first embodiment, the medallion portion has been folded and fitted into slit 12 of FIG. 6. In this embodiment the medallion is made of metal folded into functioning form. Dotted lines 4 show the flexible/pliable plastic insert 2. The tab/extension of the first part is folded inward and is inserted into top enclosed band 3, which has a slit 12 in the back portion of the enclosed band making the front portion detachable from the replaceable pocket 4.
Figure 4:
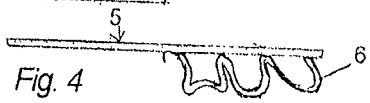
FIG. 4 is the upper view of the penholder 6 holder that may also hold other small objects. Three loops are illustrated, but the number of loops may range from one to six.
Figure 5:
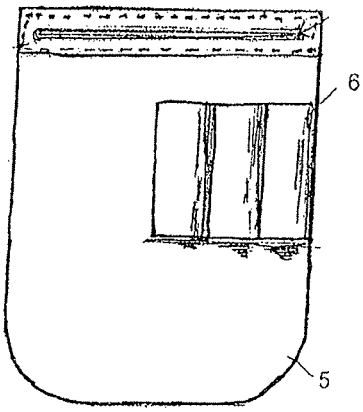
FIG. 5 is the second part back panel 6 face view of pen holder loops.
Figure 6:
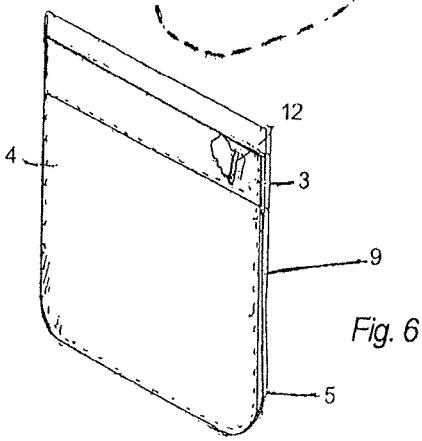
FIG. 6 is the second part of the insert 9 showing front panel and back panel attached by any suitable means including but not limited to gluing, heat bonding, sewing or another technique that forms a tight seal for slit 12.
Figure 7:
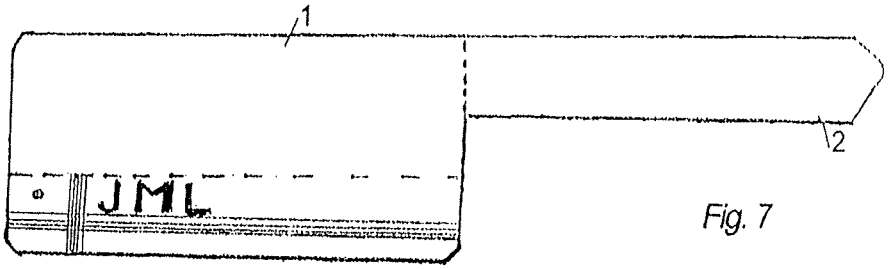
FIG. 7 illustrates details of the first embodiment of the front portion. Tab portion 2 is folded back along the dotted line and is inserted into slit 12. In an embodiment the length of the medallion, with the tab extended, is 6¼", the length of the tab alone is 3", and the width of the medallion is 2".
Figure 8:
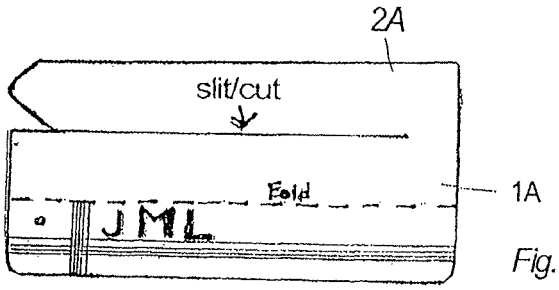
FIG. 8 illustrates a second embodiment of this invention. A slit or cut is made to create tab 2A that may be inserted into slit 12 to connect with the inner pocket.

The customizable portion of the front piece may be embossed, mechanically engraved or laser engraved. Optionally the customizable piece may be manufactured separately and attached with an adhesive or other appropriate means.

What is claimed is:

1. In a pen containing device of a type adapted to fit inside a shirt pocket, said pen containing device comprising:

a front portion that extends over and lies adjacent to said shirt pocket, said front portion comprising an exterior portion and an interior portion, wherein said exterior and interior portions are joined at a horizontal fold along the length thereof, and a horizontal tab, and a replaceable, ink impervious pocket having a top enclosed band positioned horizontally near the top of said pocket, said band comprising a slot extending horizontally along the length thereof for receiving said tab of said front portion.

2. The invention defined in claim 1 wherein said front portion is made of metal.

3. The invention defined in claim 2 wherein the front portion displays a design, drawing, monogram or name.

4. The invention defined in claim 1 wherein the replaceable ink impervious pocket is made of plastic.

5. The invention defined claim 1 wherein the replaceable ink impervious pocket is made of cloth and plastic.

6. The invention defined in claim 1 wherein a customized medallion is attached to the front portion with an adhesive.

7. The invention defined in claim 1 wherein the front portion is made of metal and the tab is folded back.

8. The invention defined in claim 1 wherein the front portion may be of metal or plastic and the tab does not require folding.

9. The invention defined in claim 1 wherein one or more loops are within the replaceable pocket.

10. The invention defined in claim 1, wherein the tab is joined with said interior portion at a fold along a portion of a side of said interior portion.

11. The invention defined in claim 1, wherein the tab is joined with said interior portion along one side of each of said tab and said interior portion.

12. The invention defined in claim 1, wherein the tab is separated from a portion of said interior portion along its length by a cut.

* * * * *